US009241518B2

(12) United States Patent
Patkov

(10) Patent No.: US 9,241,518 B2
(45) Date of Patent: Jan. 26, 2016

(54) PROTECTIVE GLOVE

(71) Applicant: 2.3.4 Skins Pty Ltd, Carlton North (AU)

(72) Inventor: Vasko Patkov, Heidelberg (AU)

(73) Assignee: 2.3.4 Skins Pty Ltd, Carlton North, Victoria (AU)

( * ) Notice: Subject to any disclaimer, the term of this patent is extended or adjusted under 35 U.S.C. 154(b) by 0 days.

(21) Appl. No.: 14/306,145

(22) Filed: Jun. 16, 2014

(65) Prior Publication Data

US 2014/0289931 A1 Oct. 2, 2014

Related U.S. Application Data

(63) Continuation-in-part of application No. 13/200,284, filed on Sep. 21, 2011, now abandoned.

(51) Int. Cl.
*A41D 19/00* (2006.01)
*A41D 19/015* (2006.01)

(52) U.S. Cl.
CPC ..... *A41D 19/01505* (2013.01); *A41D 19/001* (2013.01); *A41D 19/0006* (2013.01); *A41D 19/01547* (2013.01); *A41D 2400/34* (2013.01); *A41D 2400/44* (2013.01); *A41D 2400/52* (2013.01)

(58) Field of Classification Search
CPC . A41D 19/00; A41D 19/0006; A41D 19/001; A41D 19/015; A41D 2400/44
USPC ..... 2/168, 167, 161.7, 161.6; 128/878, 879, 128/880; 602/21, 62, 63, 64
See application file for complete search history.

(56) References Cited

U.S. PATENT DOCUMENTS

| | | | |
|---|---|---|---|
| 3,110,035 | A | 11/1963 | Lahue |
| 4,161,176 | A | 7/1979 | Harris et al. |
| 4,214,321 | A | 7/1980 | Nuwayser |
| 4,696,065 | A | 9/1987 | Elenteny |
| 5,456,354 | A | 10/1995 | Wood |
| 6,360,373 | B1 | 3/2002 | Rehn et al. |
| 6,973,675 | B2 | 12/2005 | Cheng |
| 7,743,876 | B2 | 6/2010 | Weidman |

FOREIGN PATENT DOCUMENTS

| | | |
|---|---|---|
| AU | 2010201191 A1 | 11/2010 |
| CN | 200950833 | 9/2007 |

OTHER PUBLICATIONS

Dictionary definition of "tab", downloaded from dictionary.reference.com/browse/tab on Jun. 24, 2015.

*Primary Examiner* — Anna Kinsaul
(74) *Attorney, Agent, or Firm* — TraskBritt, P.C.

(57) ABSTRACT

A glove having a plurality of discardable layers, the glove including one or more discardable outer layers that have an outer tab at a wrist area configured to facilitate removal of the outer layer; and at least one inner layer that includes an inner tab at the wrist area. The outer tab of each discardable outer layer is positioned to completely cover the tab of the at least one inner layer. The inner tab is recessed relative to the outer tab to provide a grip area on the outer tab that avoids contamination of the inner tab.

17 Claims, 7 Drawing Sheets

PROTECTIVE GLOVE

CROSS-REFERENCE TO RELATED APPLICATION

This application is a continuation-in-part of U.S. patent application Ser. No. 13/200,284, filed Sep. 21, 2011, pending, the disclosure of which is hereby incorporated herein in its entirety by this reference.

TECHNICAL FIELD

This invention relates to the area of hand hygiene and, in particular, to the use of gloves. In particular, this invention relates to the promotion of sterile handling in a range of situations from food preparation to surgical procedures using gloves.

BACKGROUND

The following references to, and descriptions of, prior proposals or products are not intended to be, and are not to be construed as, statements or admissions of common general knowledge in the art. In particular, the following prior art discussion does not relate to what is commonly or well known by the person skilled in the art, but assists in the understanding of the inventive step of the present invention of which the identification of pertinent prior art proposals is but one part.

Although the invention relates to the use of sterile gloves in a variety of applications, for convenience and ease of explanation, and by example only, the invention will be described herein in terms of its application to the food preparation industry.

It is unknown for people preparing food generally and, in particular, for those preparing food in fast food or take away outlets, as well as those serving, to wear gloves when touching the food. Unfortunately, it appears to also be customary for these same gloves to be worn when handling a purchaser's money and also for preparing food for subsequent purchasers. Accordingly, any hygiene advantages in using such gloves according to such practices are negated.

While this practice is clearly unhygienic, it is understandable that a server should do this owing to the time taken to discard an old glove and replace it with a new glove prior to serving another customer.

Other problems with the prior art are associated with the use of disposable gloves. For example, where they are used in situations where sensitivity of touch is required, they are generally sufficiently thin skinned that they can be prone to failure and can, therefore, be associated with the transmission of bacteria and contaminants. This is especially a problem for dentists, forensic police, medical practitioners, and the like.

Disclosure

It is an object of this invention to ameliorate the problems outlined above and to provide a hygienic glove device, which can be manufactured to be sufficiently robust for a range of applications while maintaining the requisite sensitivity of touch for that application.

In one aspect of the invention, there is provided a hygienic glove having a plurality of layers or skins, which glove thickness is sufficiently fine to permit the wearer to maintain an appropriate degree of manual dexterity.

It may be preferred that the glove be manufactured in such a manner as to permit the wearer to readily discard unwanted layers as required.

It is preferred that the material from which the glove is manufactured is a latex material that closely molds to the wearer's hand and flexes with corresponding movements of the hand. Any appropriate material can, however, be used.

It may be preferred that the glove have several layers where it is used for an application such as food handling, whereas a glove directed for use in more sensitive applications, such as by dentists, surgeons and other medical health professionals, may be a dual skinned latex glove that is unitary in design.

In order that the invention may be more readily understood, we shall describe it by way of non-limiting examples and specific embodiments thereof, with reference to the accompanying drawings.

DETAILED DESCRIPTION OF THE INVENTION

An inexhaustive list of alternative glove-making materials is provided below, noting that such materials may be used in composite within a single layer or glove where each layer may homogenously consist of a material that is different to other layers within the same complete glove:

| Material | Properties | Application |
|---|---|---|
| Natural rubber-latex | Durable rubber; abrasion resistant; good tactile sensation transfer | Cleaning, food processing and handling; most industrial application but |

-continued

| Material | Properties | Application |
|---|---|---|
| | | not contact with oils |
| Synthetic rubber-nitrite | Good alternative for latex-sensitive individuals; abrasion resistant | Solvent resistance (but not ketones, etc.); medical examination; emergency workers; laboratory staff; general industry, cleaning and food processing |
| Synthetic rubber neoprene | Oils, acid, solvent, caustic chemical resistance | Manufacturing, chemical handling and cleaning; not abrasion resistant |
| Polyvinyl Alcohol (PVA) | Chemical and ketone resistant, but not water and alcohol. Abrasion resistant | Selected industrial-chemical handling applications |
| Polyvinyl Chloride (PVC) | Chemical, fat, oil resistant; abrasion resistant, economical | Food contact |
| Polyethylene (PE) | Disposable; economical | Food service and general industrial applications |
| Polyurethane (PV) coated | Good dexterity and chemical resistance (except for solvents) | Parts handling |
| Cotton fiber; Polyester/cotton blend; Wool blends | Good dexterity; thermal insulation | Limited industrial applications |
| KEVLAR ®; (para-aramid synthetic fiber) and TEFLON ® (poly-tetrafluoroethylene), both available from E.I. du Pont de Nemours and Co., of Wilmington, Delaware | Coatings for cut protection; microbial and stain resistance | Limited industrial applications |

Figure 1B:
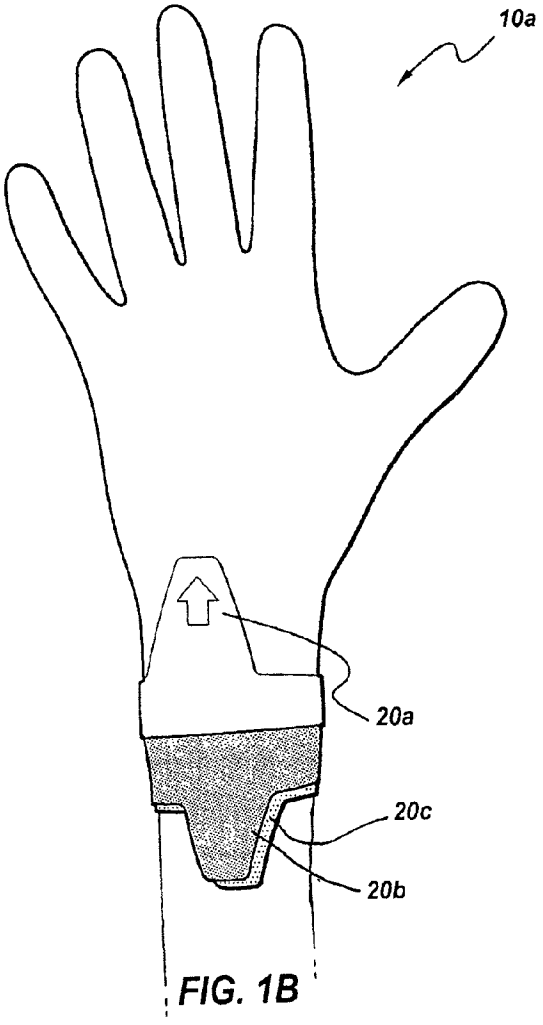
FIG. 1B is a schematic representation of a layered glove with an outer tab lifted.
Figure 1A:
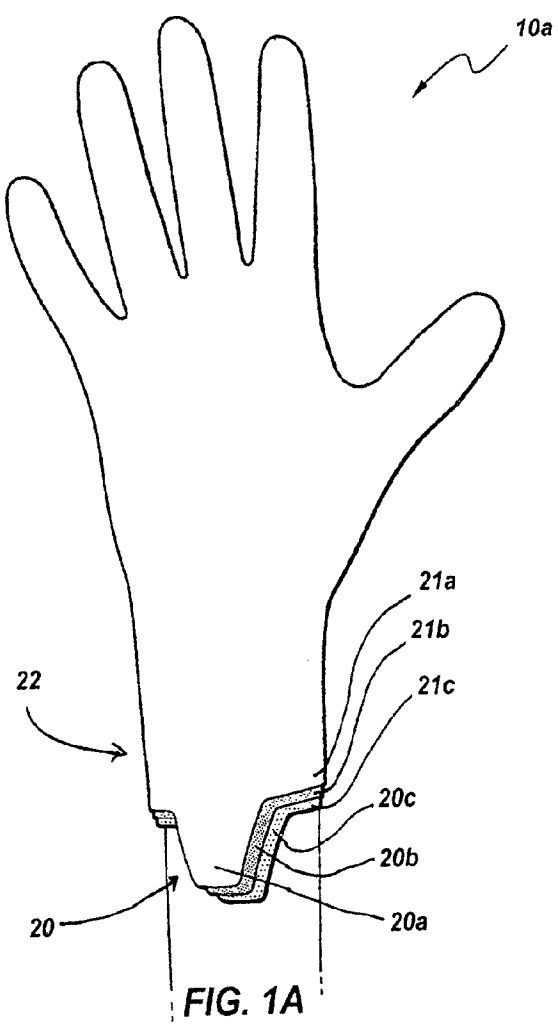
FIG. 1A is a schematic representation of a layered glove according to one aspect of the invention.

The embodiment of the invention of the type shown in FIGS. 1A and 1B is directed primarily to the food preparation industry, although it can have many other applications. This glove 10A has a plurality of disposable, relatively thin, layers or skins 21*a*-21*c*. The gloves made according to the invention will be generally referred to by the reference numeral 10 throughout the specification.

In the first embodiment of the invention shown in FIGS. 1A and 1B, a hygienic glove 10*a* having multiple removable layers is provided. Preferably, the glove 10*a* comprises multiple layers 21*a*-21*c* (the multiple layers are generally referred to by the reference numeral 21 throughout the specification) and is made of a latex material, although any appropriate material may be used. The use of latex as the multiple layer material is, however, advantageous due to its non-tacky or non-sticky properties, making easier the separation and removal of an outer layer 21*a* from its next adjacent underlying layer 21*b*.

The glove 10*a* comprises a unitary glove 10*a* that permits a user to treat the glove 10*a* as a single glove when initially putting it on. To the wearer, the glove 10*a* is a unitary piece of glovewear. The multiple layers 21*a*-21*c*, behave and perform as a single, loose-fitting glove, the collective thickness of the multiple layers 21*a*-21*c* being sufficiently thin to permit the wearer adequate tactile sensation to enable the relevant activity of the wearer to be performed. The multiple layers 21*a*-21*c* may have a tacky quality thereby tending to stick together to facilitate their performance as a single layer. For example, the layers 21*a*-21*c* may be weakly bonded by hydrogen bonds or the like, to ensure adjacent layers 21*a* and 21*b* or 21*b* and 21*c* do not slide easily with respect to one another and behave as a single layer. However, preferably, for ease of removal when an outer layer 21*a* and 21*b* is to be discarded, the respective layers are able to move and part with respect to each other, thereby facilitating separation when required. Latex material lends itself to this characteristic of non-tacky, non-stickiness.

Each outer and successive layer 21*a*-21*c* has tab means (generally referred to by the reference numeral 20 throughout the specification), whereby the outer and successive layers 21*a* and 21*b* can be readily torn off or removed from the remainder of the glove 10*a*, leaving the remaining layers 21*b*, and finally 21*c*, in place on the wearer's hand. Although the location of the tab 20 is not restricted in the invention, it is preferred that it be provided at the wrist area 22 of each layer 21*a*-21*c* so that the tab 20 can be used by the wearer to remove that layer 21*a*-21*c*.

By this means, a person can prepare food for one customer, handle their money and change (the latter operation not being critical to good hygiene), and then could simply remove the soiled outer glove layer 21*a* in order to hygienically serve the next customer, handling food with the next successive glove layer 21*b*, etc.

Although there is no limit in the invention concerning the number of layers or skins 21*a*-21*c* associated with each glove 10*a*, it is envisaged that it would be preferred for at least three to ten, preferably three to six, and more preferably three or four, such layers to be provided so that the glove 10*a* need only be replaced after serving multiple customers. This is because the glove 10*a* could become too bulky if an excessive number of layers or skins 21*a*-21*c* were used. Of course, each different type of application may require glove layers 21*a*-21*c* of differing thickness and robustness. For example, in dental or other medical surgery, where contact with sharp or pointy instruments is possible, thicker industrial layers 21*a*-21*c* may be preferred to avoid the glove 10*a* being penetrated.

Alternatively, the glove 10*a* may comprise progressively thicker layers, with thinner outer layers 21 a. Where multiple layers 21*a*-21*c* are present when the glove 10 is first put on, failure of the glove 10*a* by penetration through all layers 21*a*-21*c* is less likely and thinner outer layers 21*a* and 21*b* may be adequate. However, if only one or two remaining layers 21*b* and 21*c* are left after removal of the outer layers

21*a*, the provision of greater thickness of these inner layers 21*b* and 21*c* facilitates greater safety and resistance to a breach.

In a particularly preferred embodiment, the innermost layer 21*c* is thick, and the plurality of outer layer 21*a* and 21*b* are uniformly thin, so that the manufacturing process requires only two different settings of duration for forming each layer, a longer time to form the thicker innermost layer 21*c*, and a uniformly shorter time for each subsequent outer layer 21*a* and 21*b*.

The invention can also apply to a genuinely unitary glove 10*a*, which is not provided with the multiple layer removal facility. It is envisaged that this application would be very suitable for use in the fields of dentistry and medical treatment where a practitioner would have the benefit of a double-skinned glove to protect against tearing while not losing any significant sensitivity of touch. Because the facing surfaces of adjacent layers 21*a* and 21*b* operate as multiple surfaces with accompanying surface tensions that must be breached to be penetrated, multiple layers improve the penetration and cutting resistance of the glove 10*a*, with any cut being potentially limited to outer layers 21*a* and 21*b*, whereas a single layer having the same combined thickness, when pierced or cut, may continue to split until entirely ruptured or breached.

FIGS. 2, 3 and 4 show examples of different tabs 20 that can be used in preferred embodiments of the invention having a plurality of removable layers 21, thus demonstrating the diversity in shape and location of these tabs 20 on the glove 10. The precise shape and location of these tab devices 20 varies. Larger, more accessible tabs 20 are preferred, particularly where multiple layers 21*a*-21*c* at the finger tips may make dextrous actions more difficult, although the thinness of the multiple layers 21*a*-21*c* of the invention mitigate this problem. The finger tips 624 (see FIG. 5B) of successive layers 21 may be molded, or worked subsequent to molding, to reduce layer 21 thickness in that region for better tactile sensitivity.

In FIG. 1A, the tabs 20*a*-20*c* are generally rectangular or frusto-triangular and generally are superimposed on each other, but slightly offset to enable a finger to get underneath the top tab 20*a* and to lift it to separate it from the remaining tabs 20*b* and 20*c* to enable the removal of the outermost layer 21*a*, as demonstrated in FIG. 1B by the upward arrow.

Figure 2B:
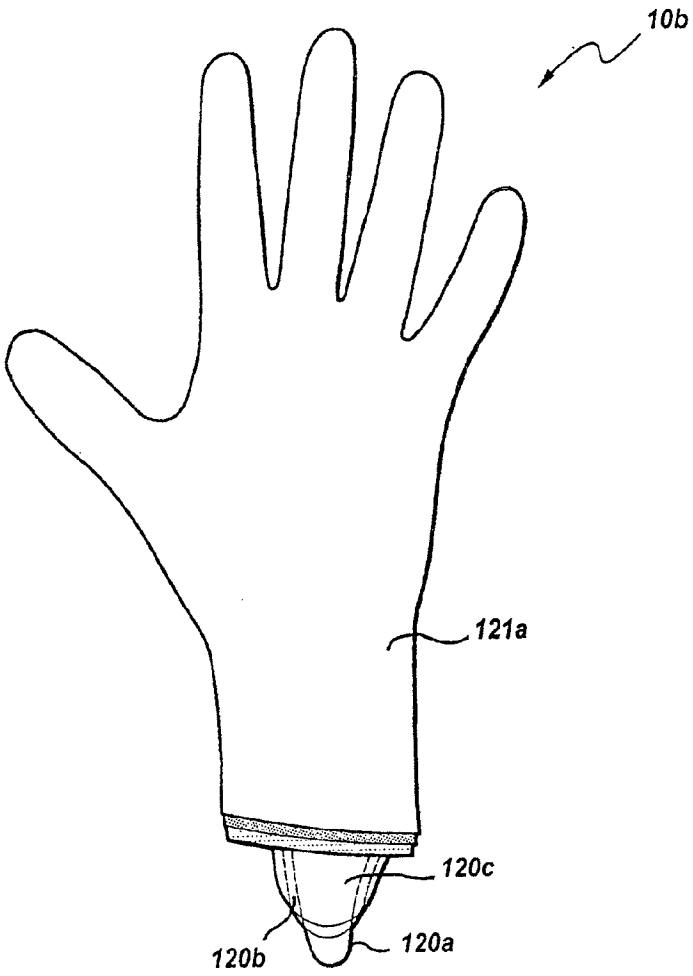
FIG. 2B is a schematic representation of a front view of the glove shown in FIG. 2A.
Figure 2A:
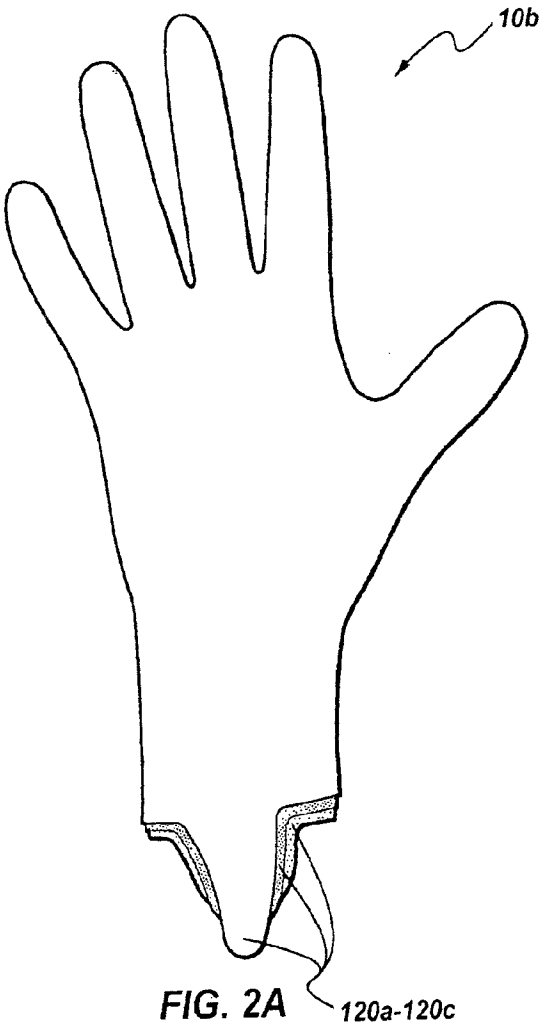
FIG. 2A is a schematic rear view of a gloves according to the embodiment shown in FIG. 1A.

In FIGS. 2A and 2B, the underlying tabs 120*b* and 120*c* are progressively broader and shorter than the long and curved elongate outer tab 120*a*. FIG. 2B shows the underlying tabs 120*b* and 120*c* as partially ghosted. They are progressively broader so that the outermost tab 120*a* or, subsequently, 120*b* after removal of outer layer 121*a*, is the longest remaining tab 120*a*, 120*b*, and is accessible to lift and separate from the other tabs 120*b*, 120*c*. The tabs 20 may be coated with a non-stick surface, such as a felt or adhesive to allow easy separation, but progressively different shaped tabs 120*a*-120*c* are preferred.

In some applications where contamination is a particularly critical issue, the tabs 20 of underlying layers 21 are preferably completely covered by the outermost remaining layer 21 to reduce the potential for contamination. In other applications, where sleeve areas 22 are unlikely to be soiled, for ease of removal of layer 21, the tabs may be more clearly separable.

Figure 3C:
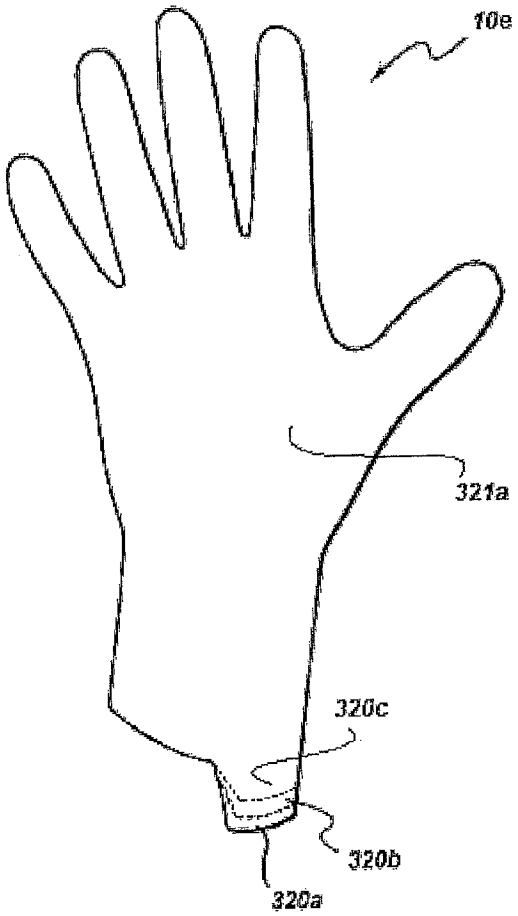
FIG. 3C is a schematic representation of another embodiment of a glove according to the invention.
Figures 3A, 3B:
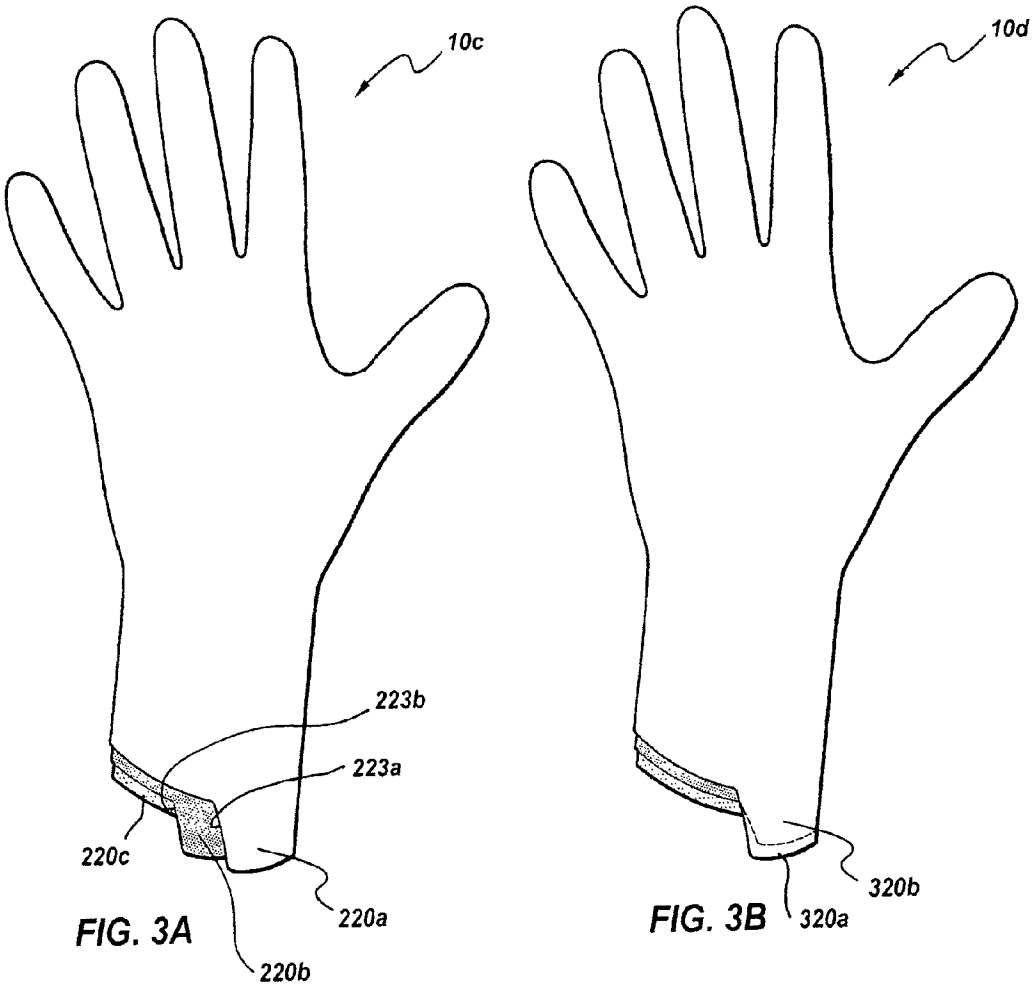
FIG. 3A is a schematic representation of a first type of tab, where a first set of tabs are offset with respect to each other.
FIG. 3B is a schematic representation of a glove having a second type of tab where one tab overlies a second tab.

In FIG. 3A, the tabs 220*a*-220*c* are circumferentially offset from each other and distinguishable by a corner cut out 223*a* and 223*b* that leaves a tab portion 220*b* and 220*c* of each sublayer 21 exposed. In FIG. 3B, the tabs 320*a* and 320*b* are a second type of tab where one tab 320*a* overlies a second tab 320*b*.

In FIG. 3C, a multiple layered glove 10*e* is shown having an outer layer 321*a* that terminates at its wrist end with an outer tab 320*a*. The outer layer 321*a* completely covers two inner layers (not shown). The next layer inward from the outer layer 321*a* terminates in a first inner wrist tab 320*b* indicated by broken lines. This first inner tab 320*b* is wholly covered and protected by the outer layer 321 a when the glove 10*e* is first used. The first inner layer associated and integrally formed in one piece with the first inner tab 320*b* is wholly and completely covered by the outerlayer 321*a* during use. The glove 10*e* includes a second inner layer that is integrally formed in one piece with a second inner tab 320*c* lying under the first inner tab 320*b*. The second inner tab 320*c* is wholly covered and protected by the first inner tab 320*b* when the outer layer 321*a* is removed. The second inner layer associated and integrally formed in one piece with the second inner tab 320*c* is wholly and completely covered by the first inner layer, and ready for a third use of the glove 10*e*, once the first inner layer has been removed. Furthermore, it will be noted that the first inner tab 320*b* is recessed so that it is optionally shorter or optionally narrower than the outer tab 320*a*. Similarly, the second inner tab 320*c* is further recessed so that it is optionally shorter or optionally narrower than the first inner tab 320*b*. The successive inner tabs 320*b* and 320*c* are preferably recessed relative to their adjacent outer tab 320*a* and 320*b* covering them to provide some clearance so that engagement of the outer tab 320*a* and 320*b* will not contaminate the next inner tab 320*b* and 320*c* prior to the use of the inner glove layer. The outer tab 320*a* of each discardable outer layer 321*a* is positioned to completely cover the tab 320*b* and 320*c* of the next inner layer 321*b* and 321*c*. The inner tab 320*b* and 320*c* is recessed relative to the next adjacent outer tab 320*a* to provide a grip area (the end zone on the outer tab 320*a* extending between the outer edge of the inner tab 320*b* and 320*c* and the outer edge of the outer tab 320*a*). By gripping the outer tab at the end zone, contamination of the next adjacent inner tab 320*b* and 320*c* can be avoided.

Figure 4B:
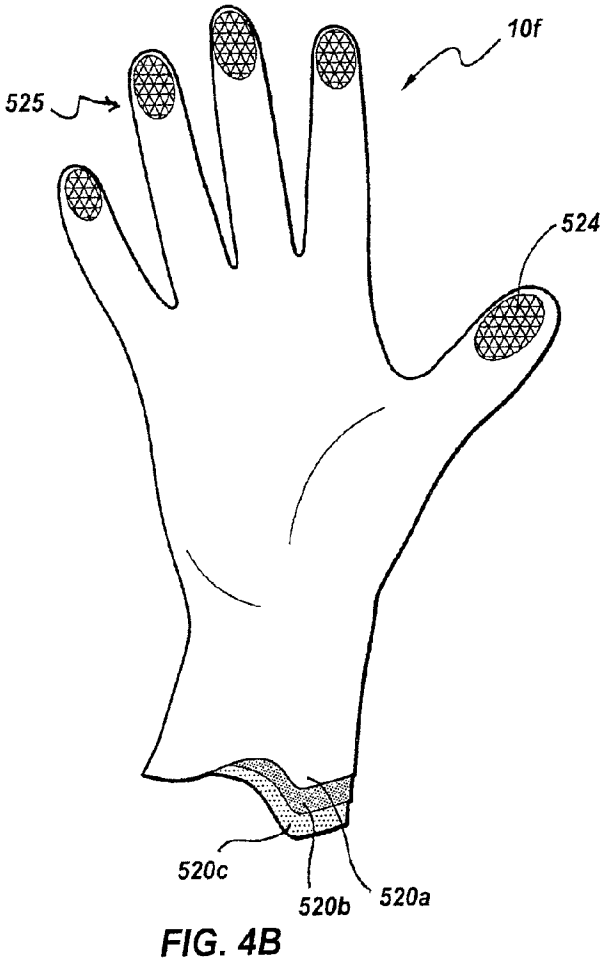
FIG. 4B is a schematic representation of a glove according to another embodiment having smaller curved tabs.
Figure 4A:
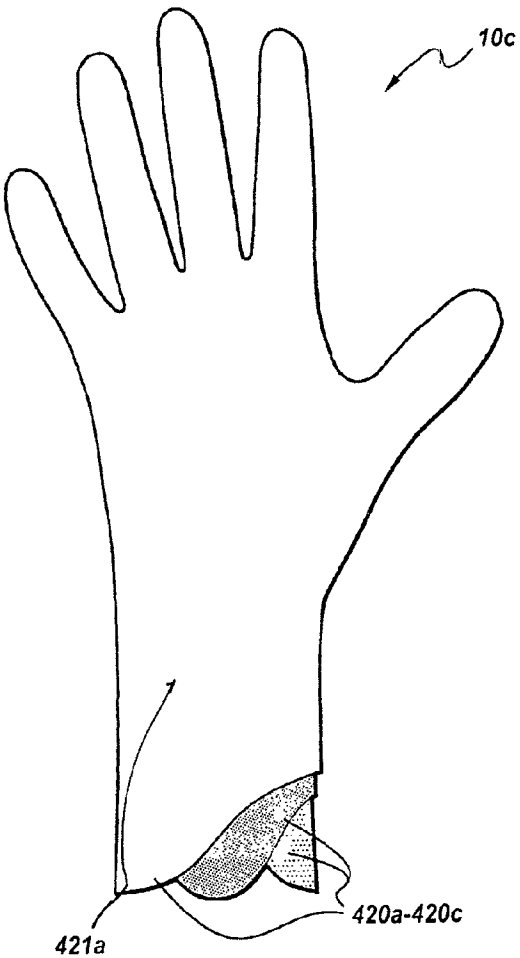
FIG. 4A is a schematic representation of a glove made according to another embodiment of the invention having large, curved tabs.

In FIG. 4A, each of the tabs 420*a*-420*c* are easily differentiated, large, curved and substantially circumferentially offset relative to each other to make separation of an individual tab 420*a* from the remaining layers 21 easier. The tabs 420*a*-420*c* define distinctly different shapes.

In contrast, the tabs 520*a*-520*c* shown in FIG. 4B follow a similar contour in which the contour of a first tab 520*a* is shadowed by a second underlying tab 520*b* and, in turn, a third tab 520*c* follows the general contour or line of intermediate tab 520*b*. The innermost tab 520*c* extends beyond the length of intermediate tab 520*b* and intermediate tab 520*b* extends less than underlying tab 520*c*.

In each case, the relative dexterity of the user as determined by the overall thickness of the glove 19*a*-19*g* may inform the type of tab 20 to be used. In FIG. 4B, rubber tips 524 are provided on the tactile side of the finer ends 525 of each glove finger for extra grip. Additional grips may be provided in the glove palm area 626 as shown in FIG. 5B.

Figure 5B:
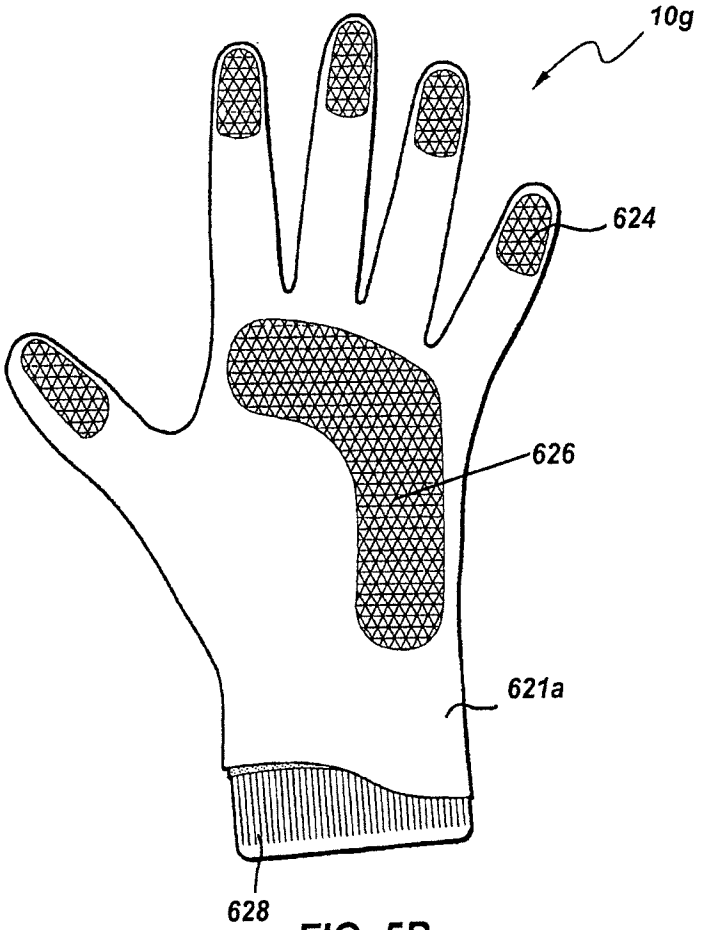
FIGS. 5A and 5B are schematic representations showing front and back views of heavy-duty lined gloves.
Figure 5A:
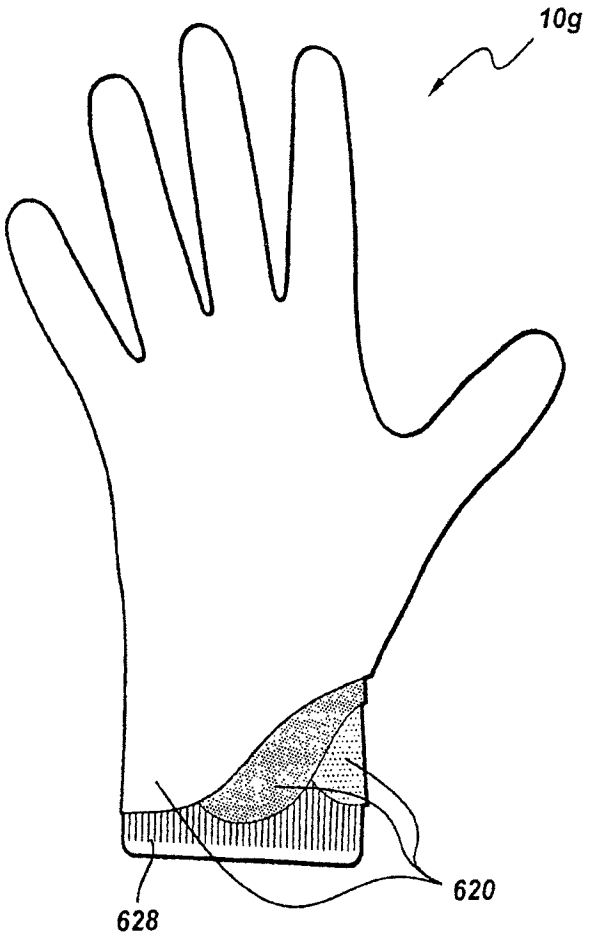

Another embodiment of the invention is shown in FIGS. 5A and 5B, which is a heavy-duty glove 10*a* that is lined in an innermost layer with a blend such as cotton, polyester and/or wool. The glove 10*g* is preferably cotton lined for use when handling frozen materials such as meats and the like, but still employs the multiple removable layer concept. The thermal insulating layer 628 remains on the wearer's hand for the duration of the glove's 10*g* use and is not intended to be used without at least one waterproof latex or other material outer layer 621*a*. The glove 10*g* comprises multiple layers 621*a* that are discardable down to the final outer waterproof, etc., layer 621*a*. After the final, innermost layer 621*a* has been used/soiled and another use is required, the glove 10*g* must be discarded and replaced with new gloves 10*g*. The innermost layer 628 includes a wrist band for comfort and stability of the glove 10*g* on the wearer's hand. The use of the loose fitting glove 10*g* is, in one application, for handling meat in a coolstore in which the handled product is heavy and slippery.

In all the applications described, it is envisaged that embodiments incorporating features such as gripping pads 624 on fingers and palms can be provided if required and still lie within the invention. The pads 624 may comprise extra pads adhered onto the outer surface of the relevant layer 21 or may represent an area of reduced thickness. The pads 624 may be molded to have a textured surface for better grip, including the provision of multiple knobs, ridges or repeated patterns such as the triangular/hexagonal pattern shown in FIG. 5B.

Figure 5C:
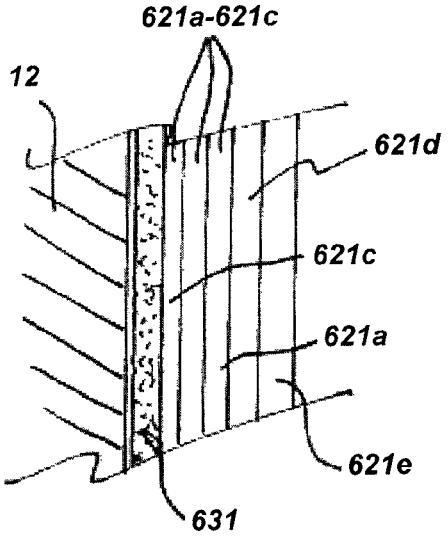
FIG. 5C is a schematic representation of layers of glove material according to the embodiment shown in FIGS. 5A and 5B.

Referring to FIG. 5C, the glove 10*g* comprises an inner cotton layer 631 that is located adjacent the user's hand 12. An insulating layer of cotton or wool/polyester blend is protected from the wet meat or other items or products to be handled, by successive discardable layers of latex 621*a*-621*c*. However, the innermost water-resistant layer 621*c* is not discarded until the entire glove 10*g* is, so that the glove 10*g* always has at least one layer 621*c* of water-resistant protection. Pads 624 are provided on the finger tips and the palm to enhance the wearer's grip of slippery and heavy meat products. As the operating temperature in such environments can be sub-zero, such as −4° C. (25° F.), the cotton or wool or blend layer 628 (see FIGS. 5A and 5B) thermally insulates the wearer's hands while providing an acceptable hypoallergenic and comfortable material against the skin.

It is further envisaged that the completed gloves can be manufactured by several means, examples of which follow.

Figure 1C:
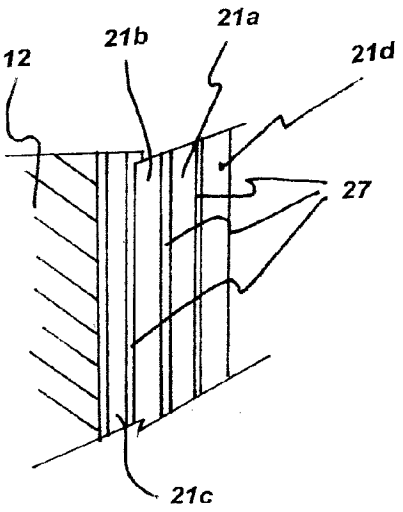
FIG. 1C is a schematic cross-sectional representation of the layers of the embodiment shown in FIG. 1A.

Referring to FIG. 1C, one manufacturing method involved is a wet process in which a mold of a hand is dipped into a vat of a liquid material such as latex and then dried, such as by being blow dried. During this stage, a tab 20 is applied, adhered, stamped or cut into the material of the newly formed layer 21 and the glove 10*a*, i.e., the immediately formed glove layer 21*c*, is then coated with a release agent 27. The release agent 27 may be a gas or may be a sprayed-on formulation. For example, the release agent 27 may be Dow Corning 200 Fluid Food Grade 350 cs or sm 2128 silicone emulsion. The release agent 27 may not remain, but may dissipate as a gas or volatile, having treated the layer 21*c* outer surface to prevent adherence by the wet and forming subsequent layer 21*b*. However, the release agent 27 may leave a non-stick residue (such as the silicone emulsion) to ensure the layers 21*a*-21*d* are slideable and separable relative to each other. This process is repeated until the required number of layers 21*a*-21*d* have been achieved.

Figure 6:
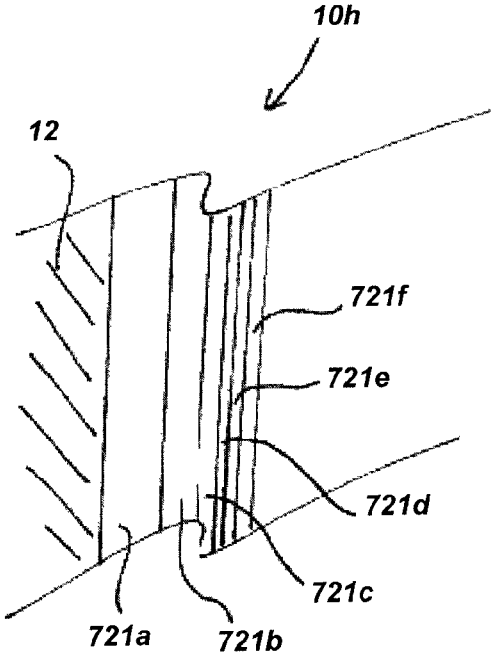
FIG. 6 is a schematic cross-sectional representation of the layers of the embodiment shown in FIG. 5A.

As shown in FIG. 6, the thickness of successive layers 721*a*-721*f* may be graded for a glove 10*h*. The innermost layer 721*a* may be sufficiently thick, thereby providing an adequate barrier on its own. Successive outer layers 721*b*-721*c* may comprise progressively thinner layer walls or all outer layers 721*d*-721*f* may be of unitary minimum thickness given that innermost layer 721*a* alone is an effective barrier.

Another manufacturing means is provided by dry spraying the glove 10*a* material onto a mold, adding the tab 20 and coating the glove 10*a* with a release agent 27, then repeating this process until the final glove 10*a* is complete.

Alternatively, a machine can be used to put preformed glove layers 21 of individual glove members 10 onto a mold by hand or by an automated process. Any appropriate method may, however, be used.

Therefore, while we have described herein specific embodiments of the invention, it is envisaged that other embodiments will exhibit any number of and any combination of the features previously described and it is to be understood that variations and modifications in this can be made without departing from the spirit and scope of the invention.

Throughout the specification and claims, the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

What is claimed is:

1. A glove comprising a plurality of discardable layers, the glove comprising:

at least one outer layer comprising a material having physical and chemical properties of water or chemical resistance and abrasion or penetration resistance; and at least one inner layer comprising a material having skin compatibility properties for use against the skin of a wearer; wherein:

each of the at least one outer layer is discardable and has an outer tab at a wrist area that is formed in one piece and integrally with the at least one outer layer;

each of the at least one inner layer has an inner tab at the wrist area that is formed in one piece and integrally with the at least one inner layer;

the outer tab is positioned to completely cover and is longer than the inner tab, wherein the inner tab is recessed relative to the outer tab; and each of the plurality of discardable layers comprises a glove in and of itself.

2. The glove according to claim 1, wherein the at least one outer layer is separable from the at least one inner layer by engagement of the outer tab that is pullable to strip the outer layer from the wearer's hand by gripping the outer tab clear of the recessed inner tab.

3. The glove according to claim 1, wherein each said outer tab is able to be manipulated to remove each successive layer of the at least one outer layer while avoiding contamination of each said inner tab recessed further down the wearer's wrist towards the fingers.

4. The glove according to claim 1, wherein the at least one inner layer comprises a different material from the at least one outer layer.

5. The glove according to claim 1, wherein the at least one outer layer comprises a plurality of layers having an average wall thickness substantially less than an average wall thickness of the at least one inner layer.

6. The glove according to claim 1, wherein the at least one outer layer comprises a plurality of outer layers that are progressively thinner layers with each successive outer layer.

7. The glove according to claim 6, wherein the at least one inner layer is significantly thicker than each outer layer of the plurality of outer layers.

8. The glove according to claim 7, wherein the at least one inner layer and the at least one outer layer comprise the same material.

9. The glove according to claim 1, wherein the at least one inner layer is treated with a release agent to prevent the at least one outer layer from adhering or sticking to the at least one inner layer.

10. The glove according to claim 1, wherein the at least one outer layer comprises latex.

11. The glove according to claim 1, wherein the at least one inner layer comprises a thermal insulating material and is adhered to the at least one outer layer immediately adjacent the at least one inner layer, the at least one outer layer additionally including one or more discardable layers having water-resistant properties.

12. The glove according to claim 1, wherein the outer tab of the outermost layer of the at least one outer layer is the only outer tab exposed for manipulation.

13. The glove according to claim 1, wherein the outermost layer of the at least one outer layer covers all of the inner tabs of the at least one inner layer lying thereunder.

14. A glove comprising a plurality of discardable layers, the glove comprising:

at least one discardable outer layer comprising an outer tab at a wrist area configured to facilitate removal of the outer layer, the outer layer comprising a glove in and of itself; and at least one inner layer comprising an inner tab at the wrist area;

wherein the outer tab of each discardable outer layer is positioned to completely cover the tab of the at least one inner layer and the inner tab is recessed relative to the outer tab to provide a grip area on the outer tab that avoids contamination of the inner tab.

15. The glove according to claim 14, wherein at least one discardable outer layer comprises a first discardable outer layer and a second discardable outer layer, wherein the outer tab of the first discardable outer layer is positioned to completely cover the outer tab of the second discardable outer layer, and wherein the outer tab of the second discardable outer layer is positioned to completely cover the inner tab of the at least one inner layer.

16. A multiple-use glove comprising a plurality of layers, the glove comprising:

at least one inner layer comprising a material having skin-compatibility properties for use against the skin of a wearer, the at least one inner layer comprising an integral inner tab at a wrist area thereof; and at least one discardable outer layer comprising a material having at least one physical or chemical property selected from the group consisting of water resistance, chemical resistance, abrasion resistance, and penetration resistance, the at least one outer layer comprising an integral outer tab at a wrist area thereof, the at least one outer layer surrounding the at least one inner layer;

wherein the outer tab is positioned to completely cover the inner tab, wherein the outer tab is longer than the inner tab, and wherein the inner tab is recessed relative to the outer tab; and wherein each of the at least one of discardable outer layers comprises a glove in and of itself.

17. The glove according to claim 1, wherein the at least one outer layer comprises a first outer layer and a second outer layer outside the first outer layer; wherein the first outer layer is thinner than the inner layer, and wherein the second outer layer is thinner than the first outer layer.

* * * * *

UNITED STATES PATENT AND TRADEMARK OFFICE

CERTIFICATE OF CORRECTION

PATENT NO. : 9,241,518 B2
APPLICATION NO. : 14/306145
DATED : January 26, 2016
INVENTOR(S) : Vasko Patkov It is certified that error appears in the above-identified patent and that said Letters Patent is hereby corrected as shown below:

In the specification:

| | | |
|---|---|---|
| COLUMN 4, | LINE 62, | change "layers **21** a." to -- layers **21***a*. -- |
| COLUMN 6, | LINE 7, | change "layer **321** a" to -- layer **321***a* -- |

Signed and Sealed this
Tenth Day of May, 2016

Michelle K. Lee

Michelle K. Lee
*Director of the United States Patent and Trademark Office*